US009839106B2

(12) United States Patent
Miller et al.

(10) Patent No.: US 9,839,106 B2
(45) **Date of Patent: *Dec. 5, 2017**

(54) FLAT-PANEL-DISPLAY, BOTTOM-SIDE, ELECTROSTATIC-DISSIPATION

(71) Applicant: Moxtek, Inc., Orem, UT (US)

(72) Inventors: Eric Miller, Provo, UT (US); Steven West Wilson, Farmington, UT (US); Sanjay Kamtekar, Highland, UT (US); Bill Hansen, Manteca, CA (US); Brad Harris, Farmington, UT (US)

(73) Assignee: Moxtek, Inc., Orem, UT (US)

( * ) Notice: Subject to any disclaimer, the term of this patent is extended or adjusted under 35 U.S.C. 154(b) by 244 days.

This patent is subject to a terminal disclaimer.

(21) Appl. No.: 14/925,490

(22) Filed: Oct. 28, 2015

(65) Prior Publication Data

US 2016/0066400 A1 Mar. 3, 2016

Related U.S. Application Data

(63) Continuation-in-part of application No. 14/739,712, filed on Jun. 15, 2015, now Pat. No. 9,779,847, and a continuation-in-part of application No. 14/920,659, filed on Oct. 22, 2015, which is a continuation-in-part of application No. 14/739,712.

(60) Provisional application No. 62/028,113, filed on Jul. 23, 2014, provisional application No. 62/079,295, filed on Nov. 13, 2014, provisional application No. 62/088,918, filed on Dec. 8, 2014, provisional application No. 62/103,392, filed on Jan. 14, 2015, provisional application No. 62/142,351, filed on Apr. 2, 2015, provisional application No. 62/159,092, filed on May 8, 2015.

(51) Int. Cl.

| | |
|---|---|
| ***G21K 5/08*** | (2006.01) |
| ***H05F 3/04*** | (2006.01) |
| ***H01J 9/00*** | (2006.01) |
| ***H01J 9/24*** | (2006.01) |

(52) U.S. Cl.

CPC ..... *H05F 3/04* (2013.01); *H01J 9/00* (2013.01); *H01J 9/241* (2013.01)

(58) Field of Classification Search

CPC ..... H05F 1/00; H05F 1/02; H05F 3/04; H05F 3/06; H01J 9/00; H01J 9/241; H01J 35/04; H01J 35/16; H05G 1/02; H05K 9/0067

See application file for complete search history.

(56) References Cited

U.S. PATENT DOCUMENTS

| | | | |
|---|---|---|---|
| 3,970,884 | A | 7/1976 | Golden |
| 4,119,234 | A | 10/1978 | Kotschak et al. |
| 5,469,490 | A | 11/1995 | Golden et al. |

(Continued)

FOREIGN PATENT DOCUMENTS

| | | | |
|---|---|---|---|
| JP | 2000/267106 | A | 9/2000 |
| JP | 2002/352997 | A | 12/2002 |

(Continued)

*Primary Examiner* — Courtney Thomas

(74) *Attorney, Agent, or Firm* — Thorpe, North & Western, LLP

(57) ABSTRACT

The invention includes a flat-panel-display (FPD) manufacturing machine which utilizes x-rays for electrostatic dissipation of a bottom side of a FPD when lifting the FPD off of a table during manufacture of the FPD. The invention also includes a method of electrostatic dissipation of a bottom side of an FPD.

20 Claims, 9 Drawing Sheets

(56) References Cited

U.S. PATENT DOCUMENTS

| | | | | |
|---|---|---|---|---|
| 5,651,045 | A | 7/1997 | Pouvesle et al. | |
| 6,205,200 | B1 | 3/2001 | Boyer et al. | |
| 6,353,658 | B1 | 3/2002 | Trebes et al. | |
| 6,563,110 | B1 | 5/2003 | Leri | |
| 6,570,959 | B1 | 5/2003 | Kuzniar | |
| 9,240,303 | B2 | 1/2016 | Barnum et al. | |
| 2004/0008818 | A1 | 1/2004 | Rangsten et al. | |
| 2005/0031083 | A1 | 2/2005 | Kindlein | |
| 2007/0188970 | A1* | 8/2007 | Inaba | B65G 49/061 361/212 |
| 2008/0110397 | A1 | 5/2008 | Hyoung | |
| 2010/0074410 | A1 | 3/2010 | Ito et al. | |
| 2013/0308756 | A1 | 11/2013 | Bogan et al. | |
| 2015/0092924 | A1 | 4/2015 | Yun et al. | |

FOREIGN PATENT DOCUMENTS

| | | | |
|---|---|---|---|
| JP | 2006/049390 | A | 2/2006 |
| JP | 2014/514718 | A | 6/2014 |
| JP | 2014/143168 | A | 8/2014 |
| KR | 10-2004-0095587 | A | 11/2004 |
| KR | 10-2007-0071298 | A | 7/2007 |
| KR | 10-2013-0018540 | A | 2/2013 |

* cited by examiner

FLAT-PANEL-DISPLAY, BOTTOM-SIDE, ELECTROSTATIC-DISSIPATION

CLAIM OF PRIORITY

This is a continuation-in-part of U.S. patent application Ser. No. 14/739,712, filed on Jun. 15, 2015, which claims priority to U.S. Provisional Patent Application Nos. 62/028,113, filed on Jul. 23, 2014, and 62/079,295, filed on Nov. 13, 2014, all of which are hereby incorporated herein by reference in their entirety.

This is a continuation-in-part of U.S. patent application Ser. No. 14/920,659, filed on Oct. 22, 2015, which claims priority to U.S. Provisional Patent Application Nos. 62/088,918, filed on Dec. 8, 2014, 62/103,392, filed on Jan. 14, 2015, 62/142,351, filed on Apr. 2, 2015, and 62/159,092, filed on May 8, 2015 which are hereby incorporated herein by reference in their entirety; and is a continuation-in-part of U.S. patent application Ser. No. 14/739,712, filed on Jun. 15, 2015, which claims priority to U.S. Provisional Patent Application Nos. 62/028,113, filed on Jul. 23, 2014, and 62/079,295, filed on Nov. 13, 2014.

This claims priority to U.S. Provisional Patent Application Ser. Nos. 62/079,295, filed on Nov. 13, 2014, 62/088,918, filed on Dec. 8, 2014, 62/103,392, filed on Jan. 14, 2015, 62/142,351, filed on Apr. 2, 2015, and 62/159,092, filed on May 8, 2015 which are hereby incorporated herein by reference in their entirety.

FIELD OF THE INVENTION

The present application is related generally to use of x-rays for electrostatic dissipation of a bottom-side of a flat-panel-display (FPD) during manufacture of the FPD.

BACKGROUND

Static electric charges on some materials, such as electronic components for example, can discharge suddenly, resulting in damage to the material. For example, static electric charges can build up on flat-panel-displays (FPD for singular or FPDs for plural) during manufacture. Static charges on a bottom side of the FPD can discharge to a support table when the FPD is lifted off of the table, causing damage to the bottom side of the FPD. It can be beneficial to provide a conductive path with proper resistance level for a gradual dissipation of such charges. Gradual dissipation of these static charges can avoid damage to sensitive components.

SUMMARY

It has been recognized that it would be beneficial to provide a conductive path with proper resistance level for a gradual dissipation of static charges on various materials, including a bottom side of a flat-panel-display (FPD for singular or FPDs for plural). The present invention is directed to various embodiments of methods and FPD manufacturing machines, with electrostatic dissipation of a bottom side of an FPD during manufacture of the FPD, that satisfy these needs. Each embodiment may satisfy one, some, or all of these needs.

The FPD manufacturing machine can comprise a table, a lift-pin, and an actuator. The table can have a hole. The lift-pin can be movably located in the hole. The actuator can exert a force on the lift-pin to at least assist in causing the lift-pin to lift the FPD off of the table. The table can be configured for mounting an x-ray tube for dissipation of static electricity on a bottom side of the FPD during manufacture of the FPD.

The method can comprise lifting the FPD off of a table and emitting x-rays between the FPD and the table when the FPD is lifted off of the table in order to ionize air to cause electrostatic dissipation of static charges on a bottom side of the FPD.

BRIEF DESCRIPTION OF THE DRAWINGS

FIGS. 1*a*-4*c* are schematic, cross-sectional side-views of a flat-panel-display (FPD) 13, and FPD manufacturing machines 10, 20, 30, and 40, in accordance with embodiments of the present invention. FIGS. 1*a*, 2*a*, 3*a*, and 4*a* show an FPD 13 supported by a table 12. FIGS. 1*c*, 2*c*, 3*c*, and 4*c* are top views of FPD manufacturing machines 10, 20, 30, and 40, respectively, without the FPD 13.

FIGS. 1*a-c* show each lift-pin 19 movably located a first hole $\mathbf{18}_f$ and each x-ray tube 11 mounted, fixed and stationary with respect to the table 12, inside a second-hole $\mathbf{18}_s$.

FIGS. 2*a-c* show that the x-ray tubes 11 can form at least a vertical segment of and can be movable along with the lift pins 19.

FIGS. 3*a-c* show that the lift-pins 19 can each be a lift-cylinder $\mathbf{19}_c$ with a hollow-core. Each x-ray tube 11 can be located inside the hollow-core of a lift-cylinder $\mathbf{19}_c$ and can be mounted fixed and stationary with respect to the table 12.

FIGS. 4*a-c* show that the x-ray tubes 11 can be located around at least a portion of a periphery of the table 12 and can be positioned to emit x-rays 17 between the table 12 and the FPD 13.

DEFINITIONS

Figure 1A:
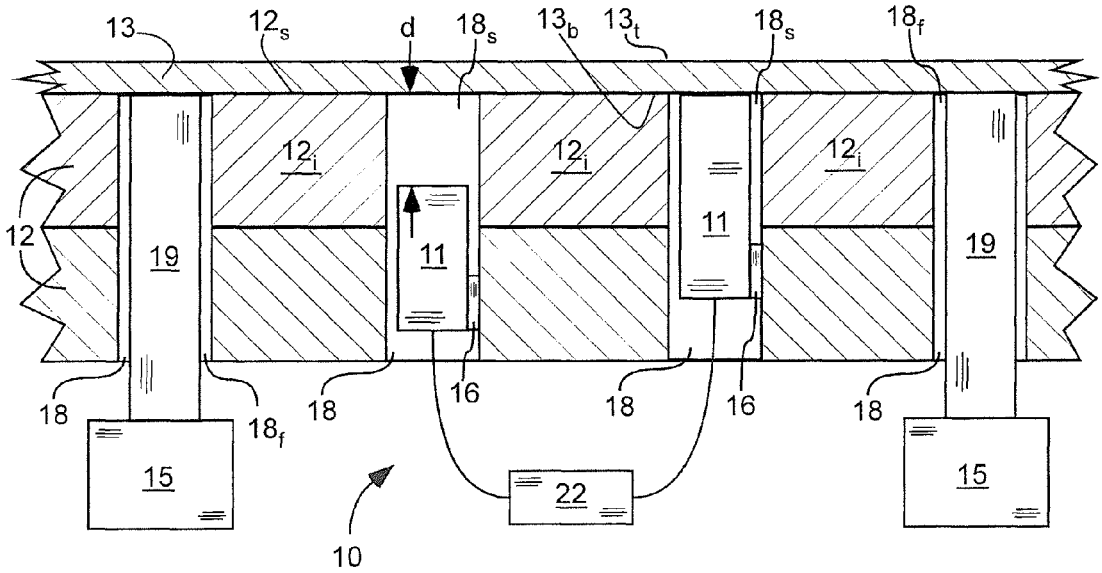

As used herein, the term "electrostatic discharge" means a rapid flow of static electricity from one object to another object. Electrostatic discharge can result in damage to electronic components.

As used herein, the term "electrostatic dissipation" means a relatively slower flow of electricity from one object to another object. Electrostatic dissipation usually does not result in damage to electronic components.

As used herein, the term "composite material" means a material that is made from at least two materials that have significantly different properties from each other, and when combined, the resulting composite material has different properties than the individual materials. Composite materials typically include a reinforcing material embedded in a matrix. One type of a composite material is carbon fiber composite which includes carbon fibers embedded in a matrix. Typical matrix materials include polymers, bismaleimide, amorphous carbon, hydrogenated amorphous carbon, ceramic, silicon nitride, boron nitride, boron carbide, and aluminum nitride.

DETAILED DESCRIPTION

Shown in FIGS. 1*a*-4*c* are flat-panel-display (FPD for singular or FPDs plural) manufacturing machines 10, 20, 30, and 40, each comprising a table 12, lift-pins 19, at least one actuator 15, and x-ray tubes 11. Shown in FIGS. 1*a*, 2*a*, 3*a*, and 4*a* are FPDs 13 supported by the table 12. At least one lift-pin 19 can at least assist in lifting the FPD 13 off of the table 12. Shown in FIGS. 1*b*, 2*b*, 3*b*, and 4*b* are FPDs 13 supported by the lift pins 19 above the table 12. Shown in FIGS. 1*c*, 2*c*, 3*c*, and 4*c* is a top view of the table 12, the lift pins 19, and the x-ray tubes 11 without the FPD 13.

Electrostatic charges can build up on the FPD 13 during manufacture of the FPD 13. Rapid electrostatic discharge of such electrostatic charges can cause damage to the FPD 13. Relatively slower electrostatic dissipation of such electrostatic charges can avoid this damage. Various methods have been used for electrostatic dissipation of electrostatic charges on a top side $\mathbf{13}_t$ of the FPD 13. Electrostatic dissipation at an opposite, bottom side $\mathbf{13}_b$ of the FPD 13 can be more difficult because the table 12, used to support the FPD 13, can block electrostatic dissipation equipment. Damage to the bottom side $\mathbf{13}_b$ of the FPD 13, due to electrostatic discharge, typically occurs as the FPD 13 is raised off of the table 12 by the lift-pins 19.

As shown in FIGS. 1*a*-4*c*, one or more x-ray tubes 11 can be located to emit x-rays 17 between the table 12 and the bottom side $\mathbf{13}_b$ of the FPD 13 when lifting the FPD 13 off of the table 12. The x-rays 17 can be soft or low-energy x-rays. These x-rays 17 can form ions in air between the FPD 13 and the table 12. The ions can gradually dissipate electrostatic charges on the bottom side $\mathbf{13}_b$ of the FPD 13, thus avoiding rapid electrostatic discharge at, and damage to, the bottom side $\mathbf{13}_b$ of the FPD 13. These designs can allow electrostatic dissipation of the difficult-to-access bottom side $\mathbf{13}_b$ of the FPD 13. The FPD manufacturing machines 10, 20, 30, and 40 can also include a controller 22 configured to cause the x-ray tube(s) 11 to emit the x-rays 17 between the FPD 13 and the table 12 when the lift-pin(s) 19 lift the FPD 13 off of the table 12. The controller 22 can include a power supply or power supplies for the x-ray tubes 11.

The table 12 can include an electrically-insulative outer-layer $\mathbf{12}_i$ located to face and contact the FPD 13. The table 12 can also include one or more holes 18. Each hole 18 can extend through the table 12. Each lift-pin 19 can be movably located in a hole 18. There can be an air gap around each lift-pin 19 to allow the lift-pin 19 can move freely in the hole 18. The actuator(s) 15 can exert a force on each lift-pin 19 to cause the lift-pins 19 to lift the FPD 13 off of the table 12.

The table 12 can be configured for mounting x-ray tube(s) 11 for dissipation of static electricity on a bottom side $\mathbf{13}_b$ of the FPD 13 during manufacture of the FPD 13 by one or more of the following:

1. The holes 18 in the table 12 can include one or more first holes $\mathbf{18}_f$ and one or more second holes $\mathbf{18}_s$. Each lift-pin 19 can be located in one of the first hole(s) $\mathbf{18}_f$. Each second hole $\mathbf{18}_s$ can be free of any lift-pin 19 configured to at least assist in lifting the FPD 13. The second hole(s) $\mathbf{18}_s$ can be reserved for x-ray tube(s) 11, as will be described below in reference to FIGS. 1*a*-*c*.
2. The lift-pin(s) 19 can have a section reserved for adding the x-ray tubes 11. This section can be a vertical section of or even the entire lift-pin(s) 19, as will be described below in reference to FIGS. 2*a*-*c*; or this can be a hollow-core, as will be described below in reference to FIGS. 3*a*-*c*.
3. The table 12 can include frames 41 for mounting the x-ray tubes 11, as will be described below in reference to FIGS. 4*a*-*c*.

Figure 1B:
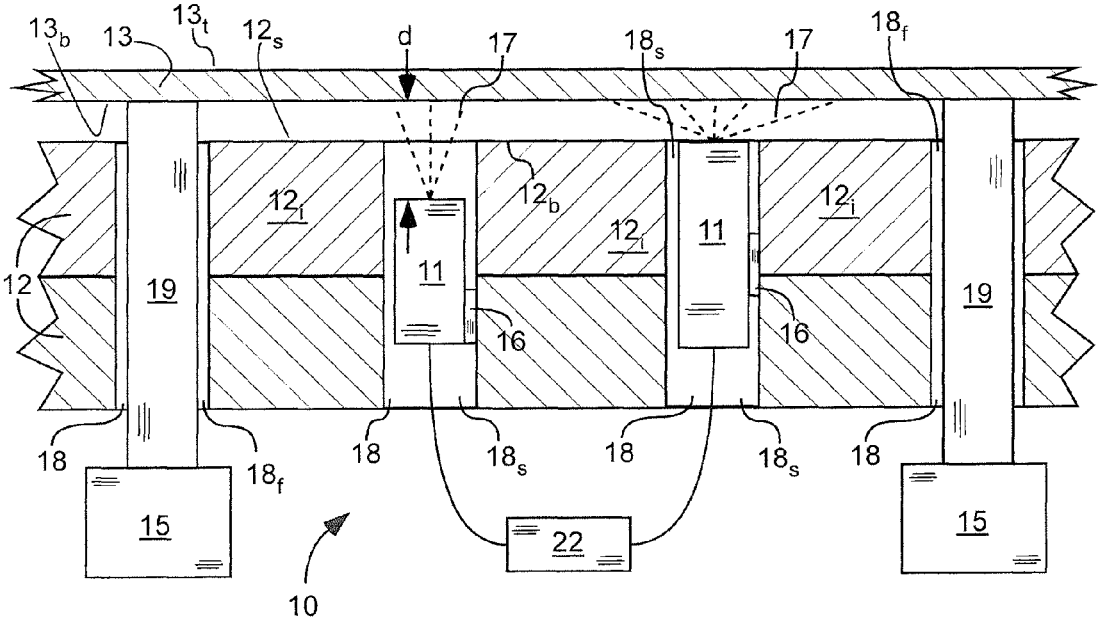
FIGS. 1*b*, 2*b*, 3*b*, and 4*b* show the FPD 13 raised off of the table 12 and supported by lift-pins 19.
Figure 1C:
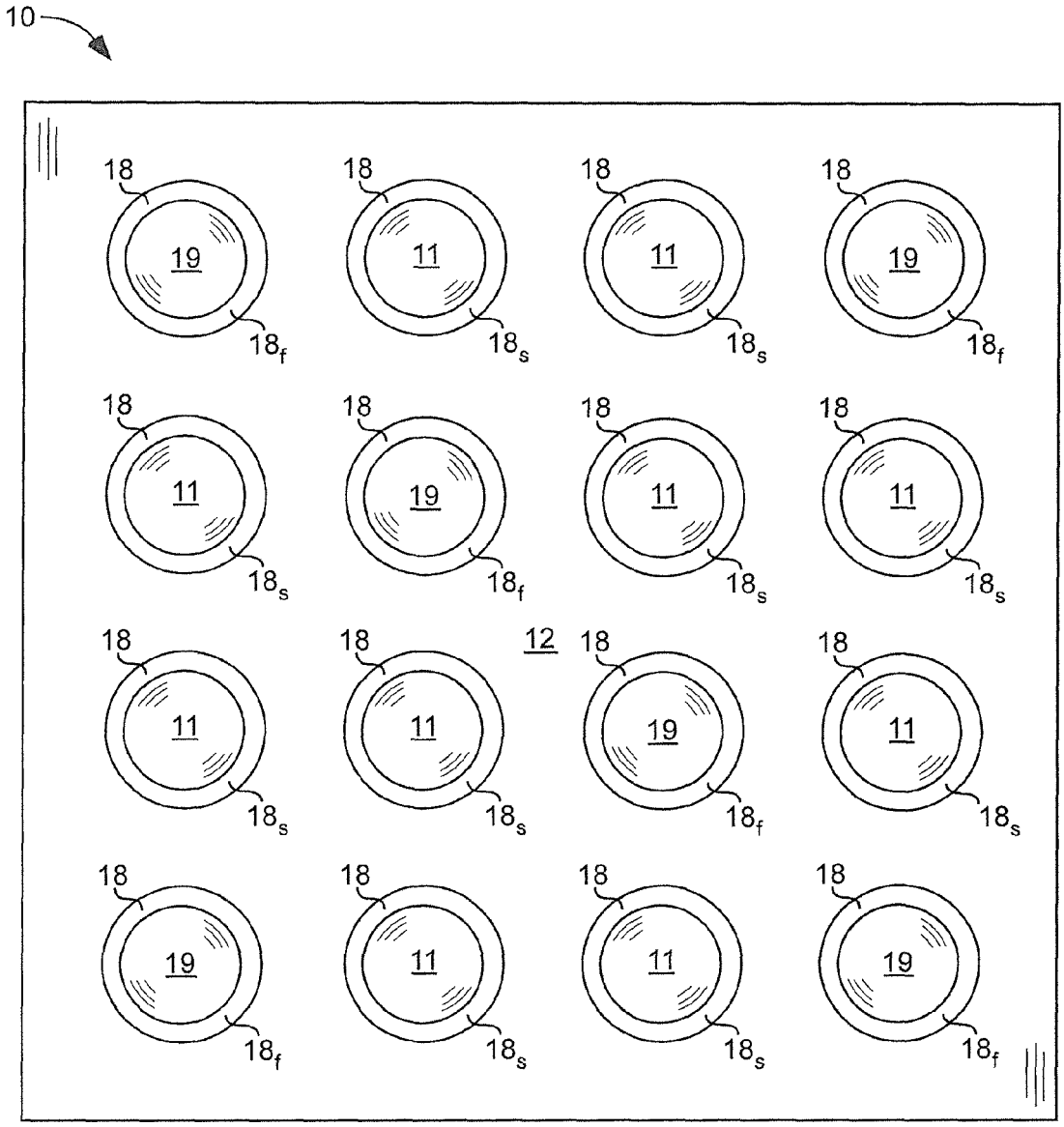

As shown in FIGS. 1*a*-*c*, the hole(s) 18 can include at least one first hole $\mathbf{18}_f$ and at least one second hole $\mathbf{18}_s$. The lift-pin(s) 19 can be movably located in a first hole $\mathbf{18}_f$ but not in a second hole $\mathbf{18}_s$. The x-ray tube(s) 11 can be mounted, fixed and stationary with respect to the table 12, inside a second hole $\mathbf{18}_s$. The table 12 can have a bearing-surface $\mathbf{12}_s$ for holding the FPD 13. In one aspect, an x-ray emission-end of the x-ray tube(s) 11 can be located from flush with, to a distance d of up to 10 millimeters below, the bearing-surface $\mathbf{12}_s$ of the table 12.

Figure 2A:
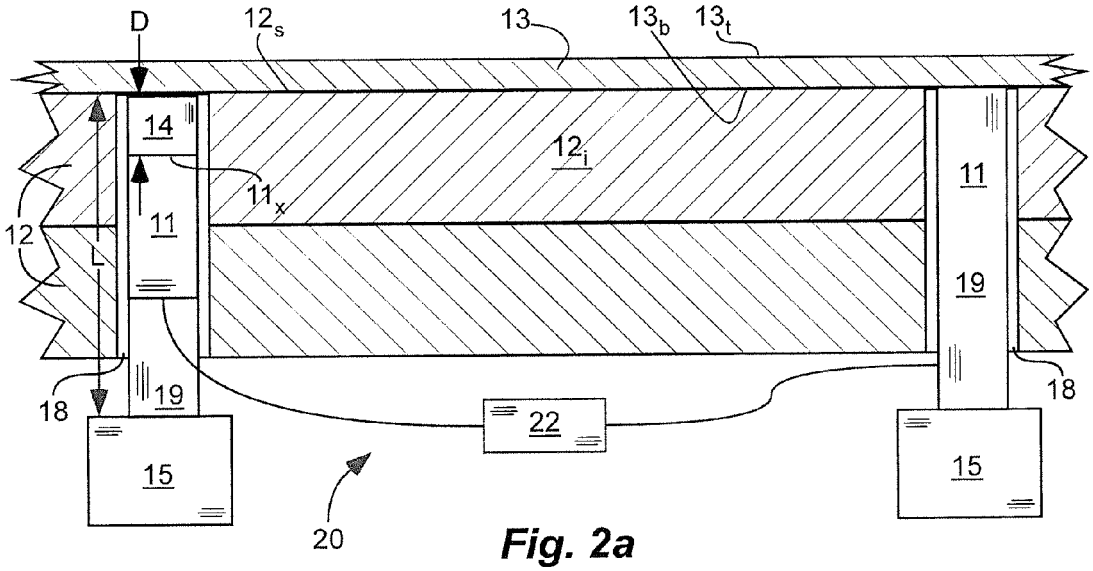
Figure 2B:
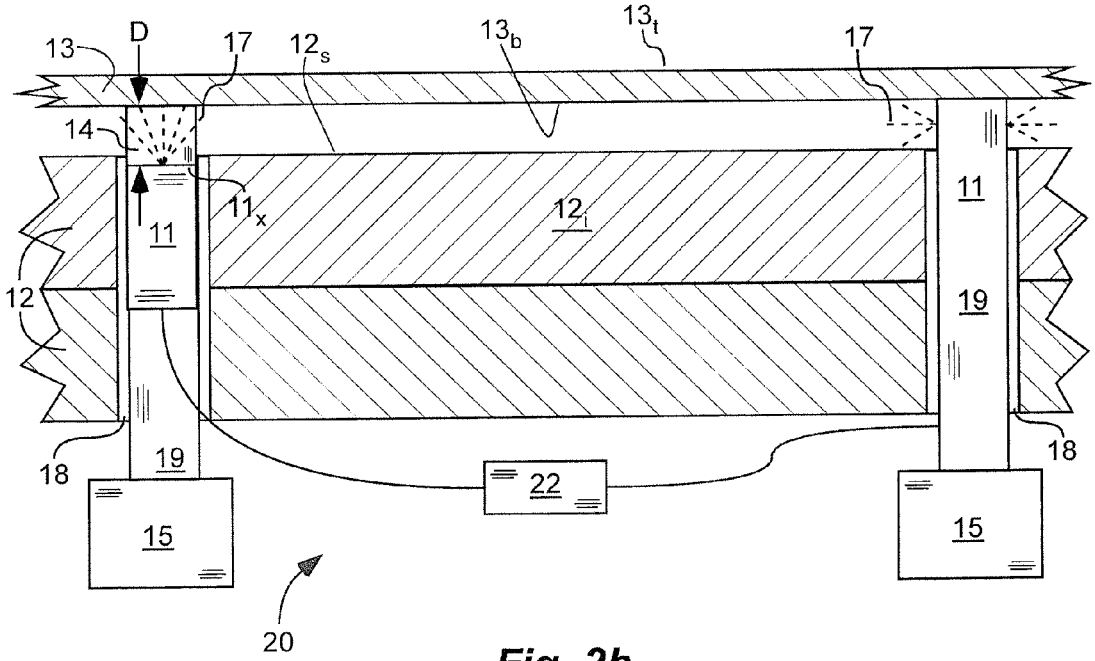
Figure 2C:
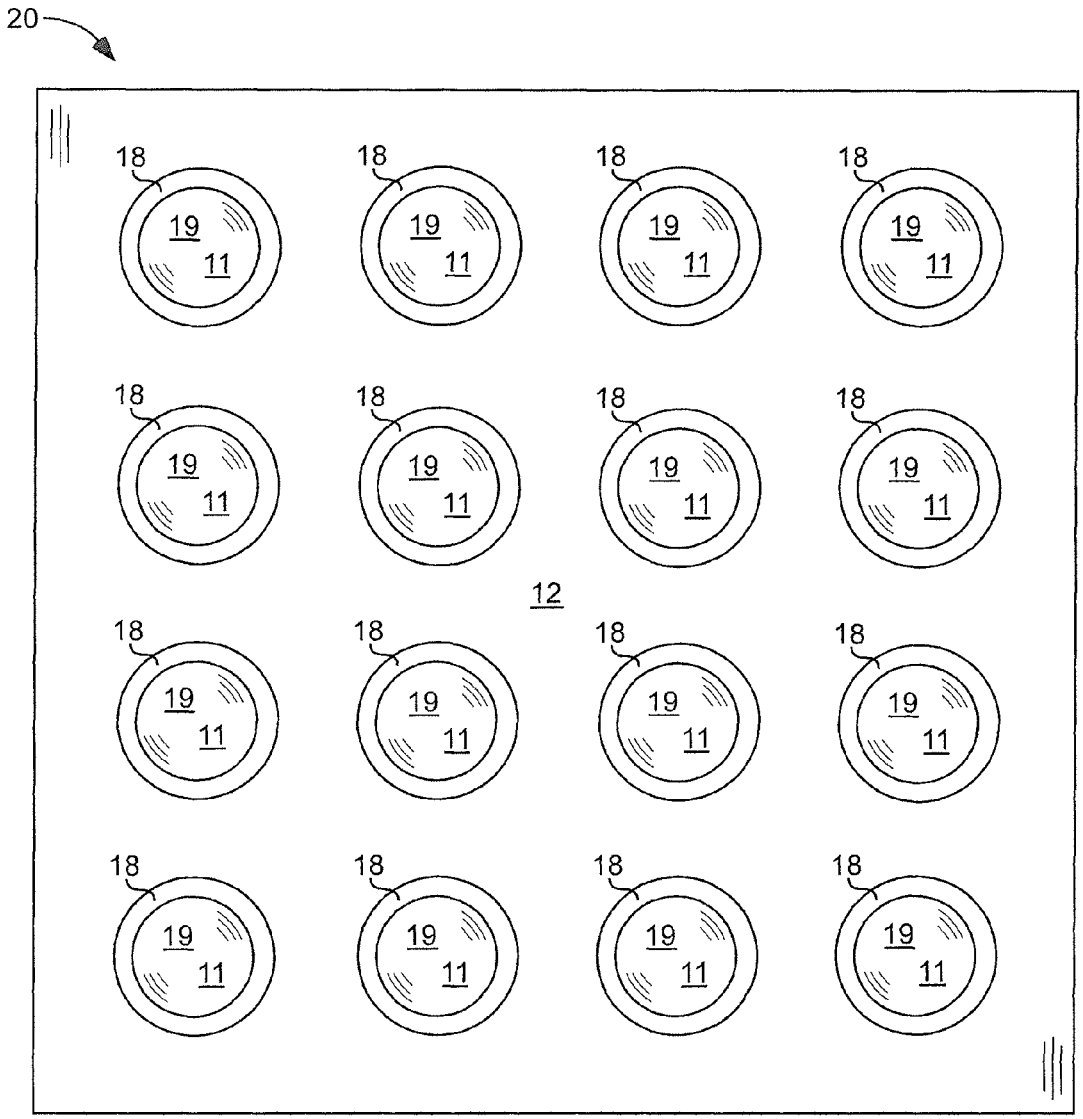

As shown in FIGS. 2*a*-*c*, the x-ray tube(s) 11 can form a portion of a length L (i.e. a vertical segment) of the lift-pin 19 (see lift-pin 19 and x-ray tube 11 on the left side of FIGS. 2*a*-*b*). The x-ray tube 11 can be the entire lift-pin 19 (see lift-pin 19 and x-ray tube 11 on the right side of FIGS. 2*a*-*b*). The x-ray tube(s) 11 can be moveable along with the lift-pin(s) 19. Thus, the x-ray tube(s) 11 can be used to at least assist in lifting the FPD 13.

A spacer 14 can be located at an x-ray emission-end one or more of the x-ray tubes 11. The spacer 14 can be a vertical segment of the lift-pin(s) 19. The spacer 14 can maintain a predetermined distance D (e.g. between 3-10 millimeters) between the x-ray emission-end of the x-ray tube(s) 11 and the FPD 13 when lifting the FPD 13, thus allowing space for the x-rays 17 to spread out and form ions.

It can be important to avoid electrical current flow from the x-ray tube(s) 11 to the FPD 13. The spacer 14 can be electrically-insulative to electrically insulate the x-ray tube(s) 11 from the FPD 13. The spacer 14 can include or can be a polymer, such as polyether ether ketone (PEEK).

The spacer 14 can be hollow to form a region for formation of ions. The spacer 14 can be vented to allow passage of the ions and x-rays 17 outward from the spacer 14. The spacer 14 can be at least part of a shell, a hollow region of the shell extending beyond the emission-end of the x-ray tube(s) 11, a cap, or combinations thereof, as described in U.S. patent application Ser. No. 14/920,659, filed on Oct. 22, 2015, incorporated herein by reference.

Figure 3A:
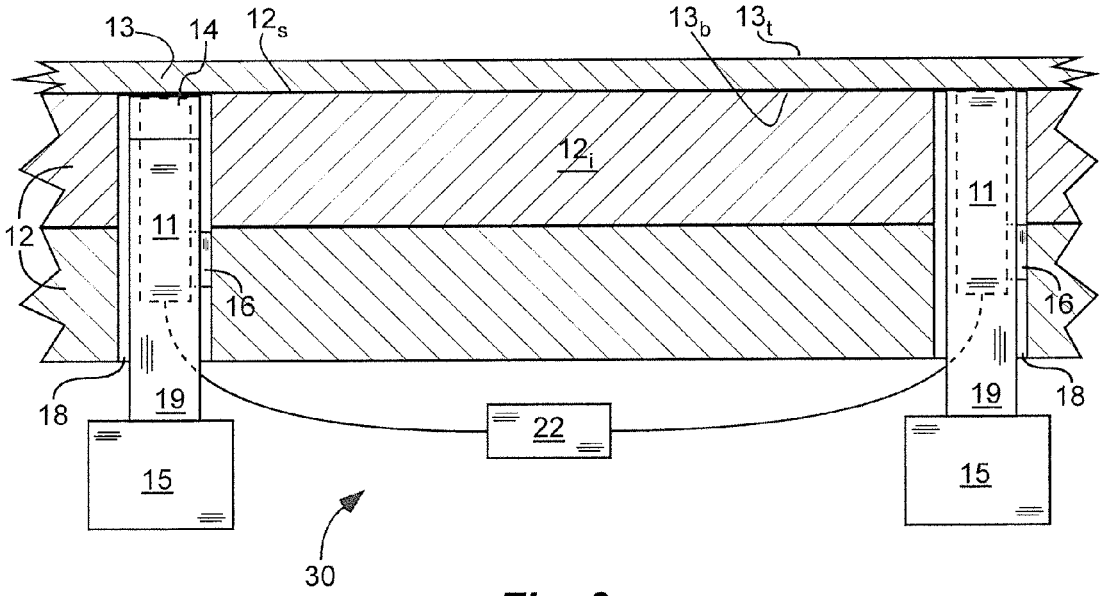
Figure 3B:
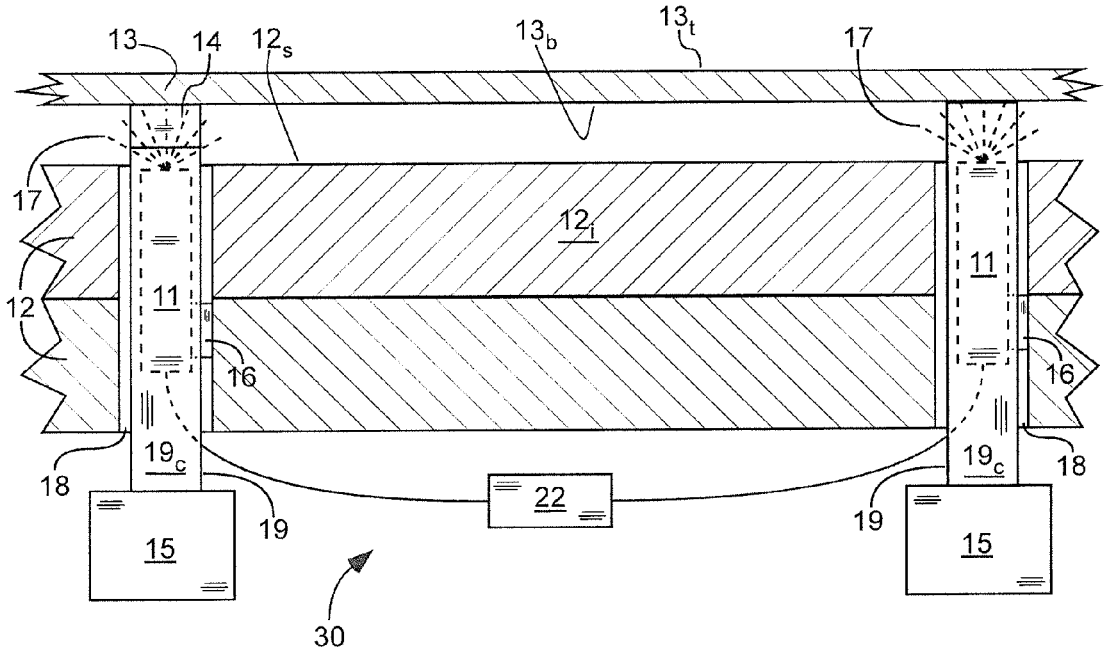
Figure 3C:
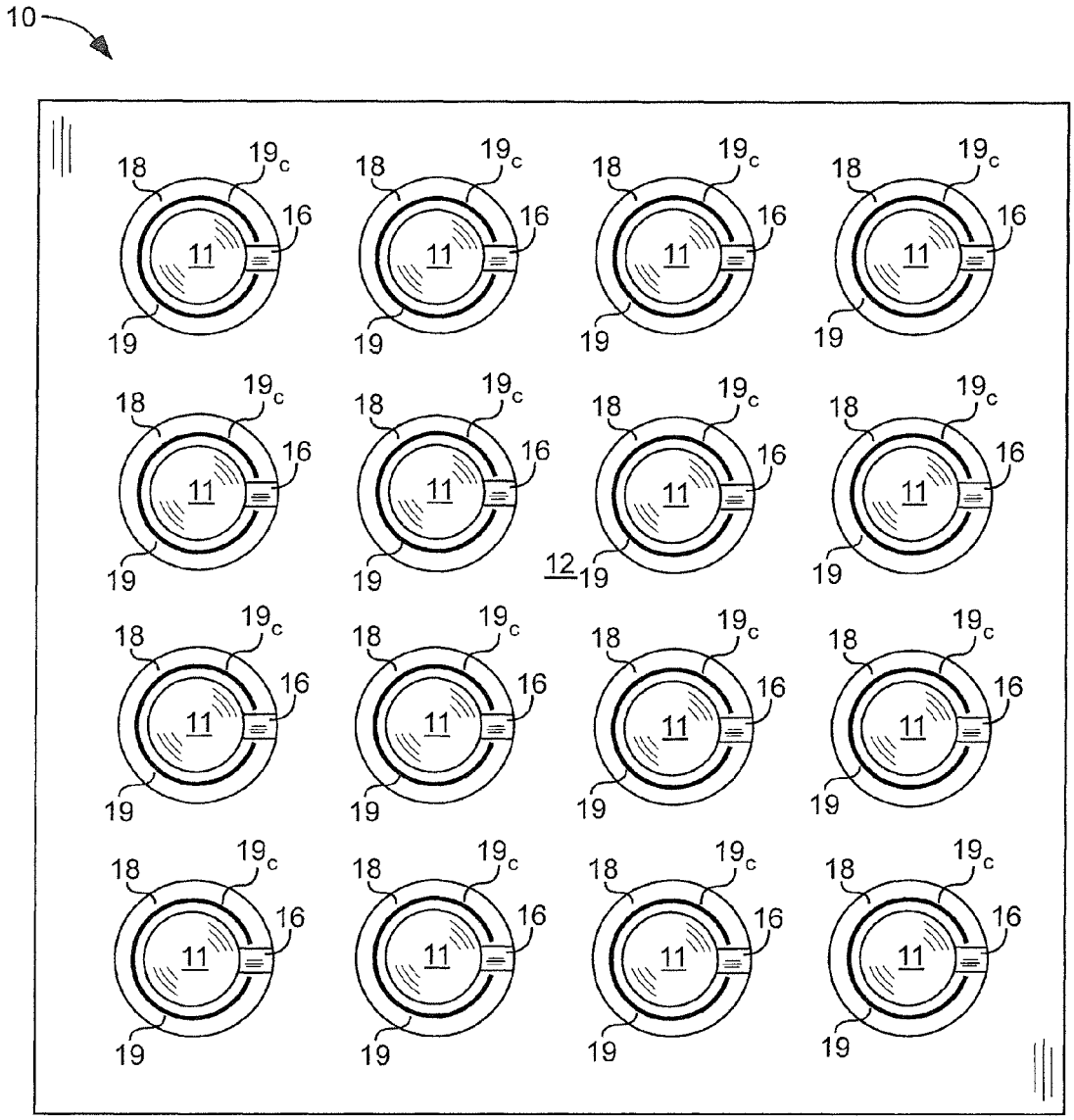

As shown in FIGS. 3*a*-*c*, one or more of the lift-pins 19 can each be a lift-cylinder $\mathbf{19}_c$, each with a hollow-core. An x-ray tube 11 can be located inside the hollow-core of each of the lift-cylinders $\mathbf{19}_c$, and can be mounted fixed and stationary with respect to the table 12, such as by a mount 16. The lift-cylinders $\mathbf{19}_c$ can comprise a material that is strong enough for lifting the table 12 and can be substantially transmissive to soft x-rays, such as carbon fiber composite for example. The lift-cylinders $\mathbf{19}_c$ can be vented with holes or channels to allow ions and/or x-rays 17 to more easily pass outside of the hollow-core of the lift-cylinders $\mathbf{19}_c$.

Figure 4A:
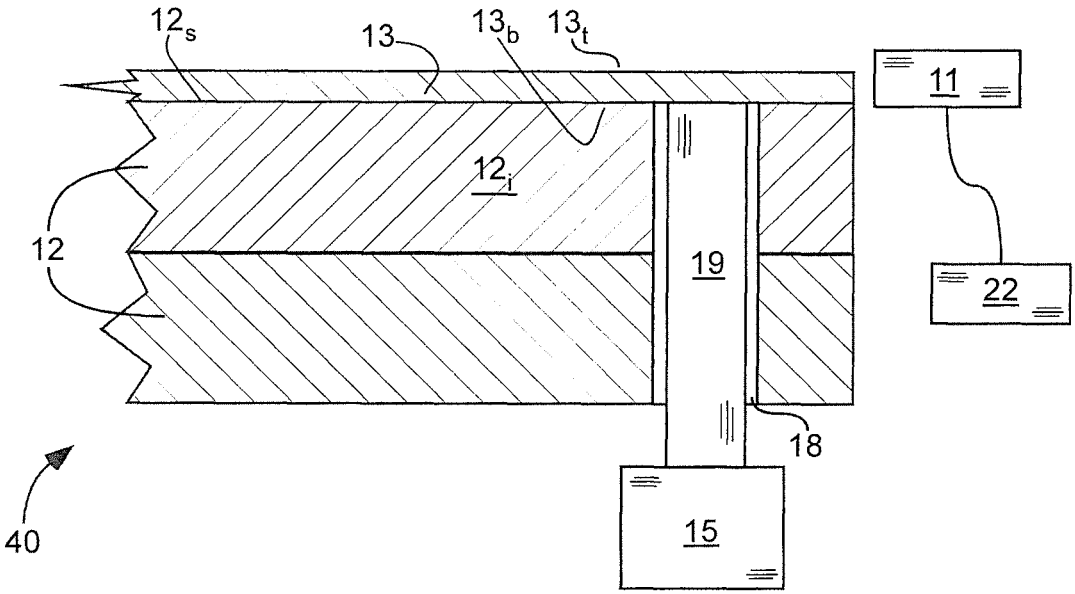
Figure 4B:
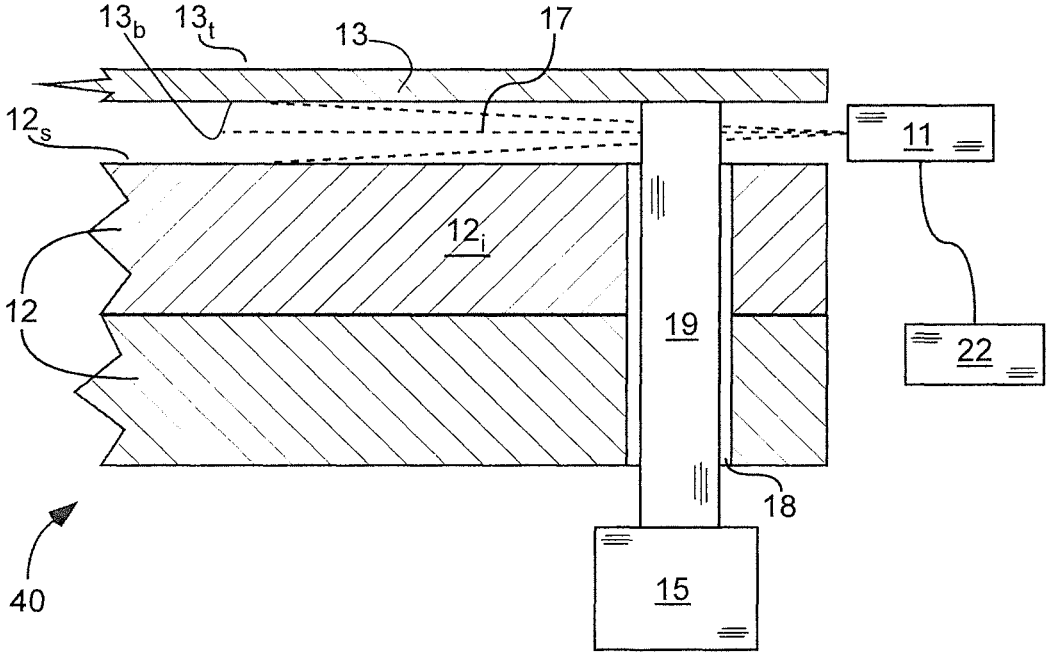
Figure 4C:
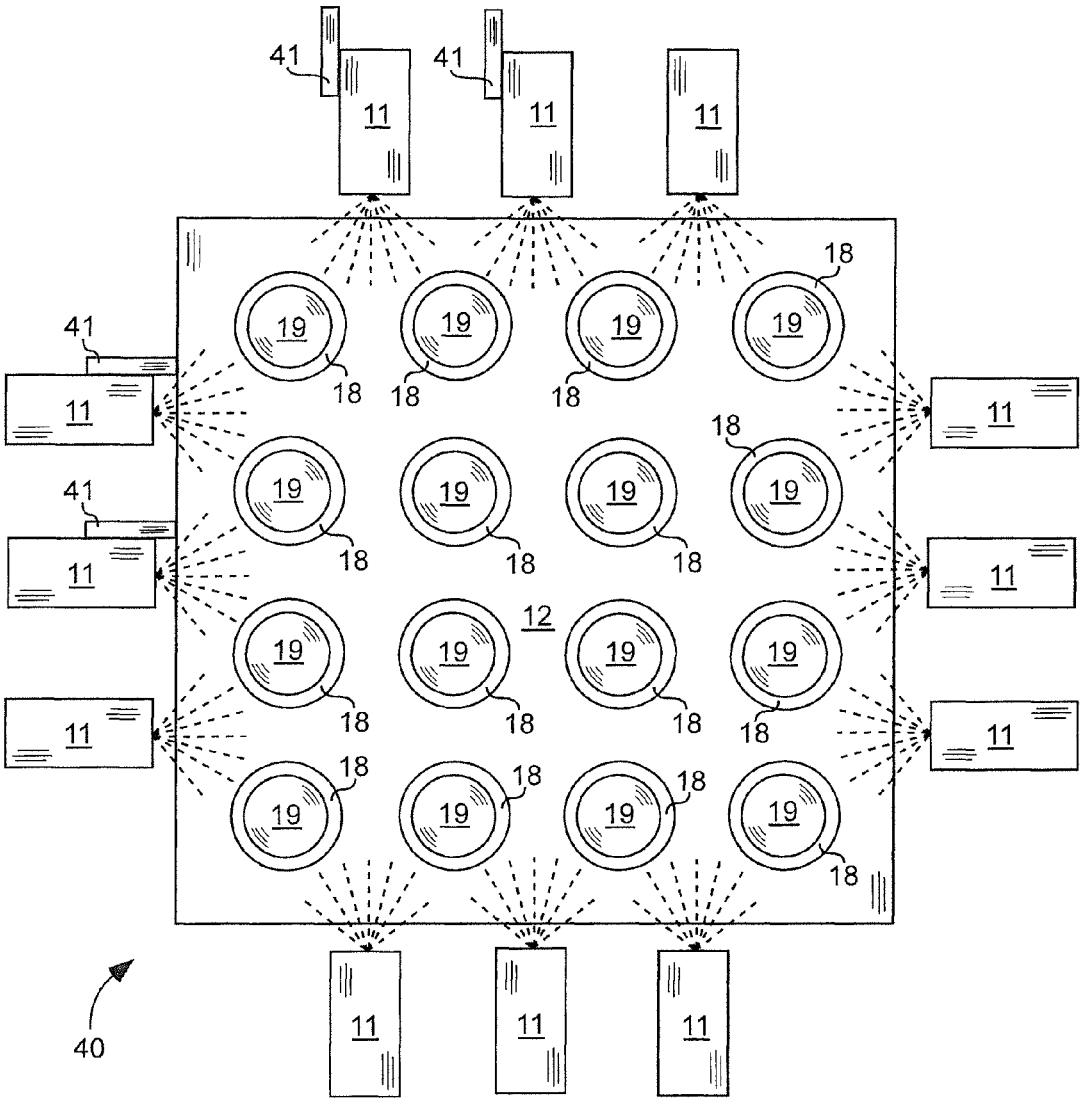

As shown in FIGS. 4*a*-*c*, one or more the x-ray tubes 11 can be located around all or a portion of a periphery of the table 12 and positioned to emit x-rays 17 between the table 12 and the FPD 13 when the FPD is raised. The x-ray tubes 11 can circumscribe the table 12. The x-ray tube(s) 11 can be oriented substantially parallel with the bearing-surface $\mathbf{12}_s$ of the table 12. As shown in FIG. 4*c*, the x-ray tube(s) 11 can be attached to the table 12, or to some other device, by frame(s) 41.

Each design has its advantages and disadvantages which can be considered for each situation or FPD manufacturing machine. An advantage of the designs of FIGS. 1*a*-3*c* over the design of FIGS. 4*a*-*c* can be emission of x-rays 17 in a center region of the FPD 13. An advantage of the design of FIGS. 4*a*-*c* over the designs of FIGS. 1*a*-3*c* can be ease of installation of the x-ray tube(s) 11, i.e. no changes are needed to hole(s) 18 in the table 12 or to the lift-pin(s) 19.

An advantage of the design of FIGS. 1*a-c* over the designs of FIGS. 2*a*-3*c* can be increased flexibility of potential x-ray tube location(s), and thus possibly improved electrostatic dissipation. An advantage of the designs of FIGS. 1*a-c* & 3*a-c* over the design of FIG. 2*a-c* can be broader angle of x-ray emission before reaching the table 12 because the x-ray tube(s) 11 are not raised as the lift-pin(s) raise; however the design of FIGS. 2*a-c* may be preferred if each x-ray tube 11 gives a 360° emission of x-rays 17 around a circumference of the x-ray tube 11. Cost, potential blocking of x-rays 17, and lift-pin 19 strength, can be considered in deciding between the various designs. A combination of the above designs can also be used.

Figure 5:
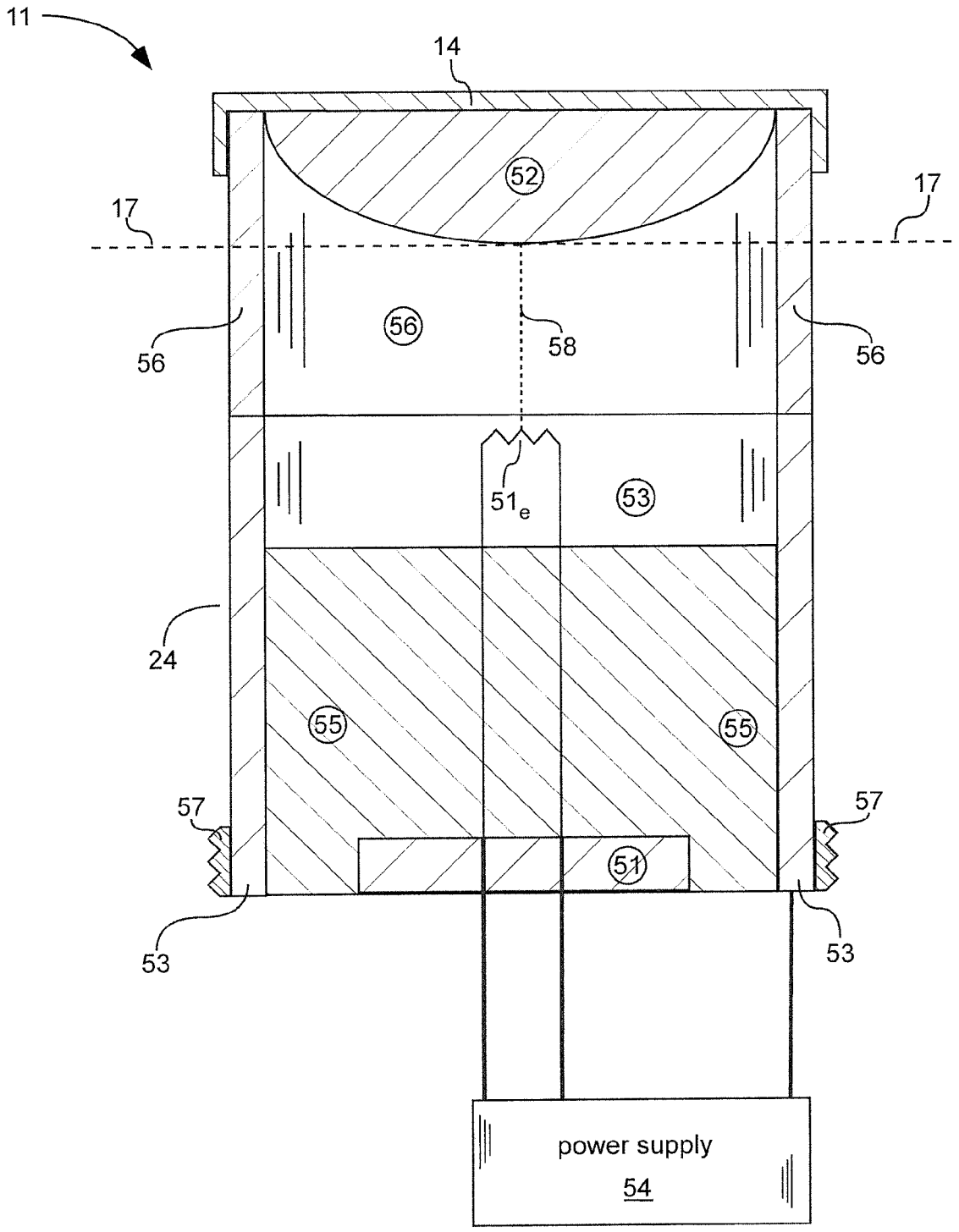
FIG. 5 is a schematic, cross-sectional side-view of an x-ray tube 11 that can provide a 360° emission of x-rays around a circumference of the x-ray tube 11, and that has a cathode 51 with electron emitter $\mathbf{51}_e$, and an anode 52 with a protrusion or convex surface, such as a hemisphere or a half-ball-shape, extending towards the cathode 21 or electron emitter $\mathbf{51}_e$.

Shown in FIG. 5 is an example of an x-ray tube 11 that can provide a 360° emission of x-rays around a circumference of the x-ray tube 11. The x-ray tube 11 can include a cathode 51 and an anode 52. The cathode 51 can include an electron emitter $\mathbf{51}_e$ which can be configured to emit electrons 58 towards the anode 52 due to heat and/or due to a large voltage differential between the cathode 51 and the anode 52. The anode 52 can be configured to emit x-rays 17 outward from the x-ray tube 11 in response to the impinging electrons 58 from the electron emitter $\mathbf{51}_e$. For example, the electrons 58 can excite atoms in a target material on the anode 52, causing these atoms to emit x-rays 17.

The anode 52 can have a protrusion or convex surface, such as a hemisphere or a half-ball-shape, extending towards the cathode 21 or electron emitter $\mathbf{51}_e$. The protrusion can improve voltage gradients, making easier emission of electrons 28 to the anode 22, and can allow 360° emission of x-rays 17. The convex surface can include the target material, e.g. tungsten. The anode 52 can be made of or can comprise various materials, such as for example refractory metals, tungsten, metal carbide, metal boride, metal carbon nitride, and/or noble metals.

The x-ray tube 11 can include an enclosure 53 that can be annular-shaped. The enclosure can be made of a strong material (e.g. a composite material) to allow the enclosure 53 to hold at least a portion of the weight of the FPD 13. The enclosure 53 can be electrically-conductive or electrically-insulative. If the enclosure is electrically-conductive, it can be insulated from the cathode 51 by an electrically-insulative material 55.

The enclosure 53 can include a window 56 that is annular-shaped to allow x-rays 17, generated at the anode 52, to emit outwards in a 360° arc in a latitudinal direction outward from the x-ray tube 11. A 360° emission of x-rays 17 can be effective at forming a large number of ions between the FPD 13 and the table 12, resulting in effective electrostatic dissipation of the FPD 13. The window 56 can be one part of the enclosure 53 or can be the entire enclosure 53.

The window 56 can be made of or can comprise various materials, such as for example carbon fiber composite, graphite, plastic, glass, beryllium, and/or boron carbide. Advantages of using a carbon fiber composite include low atomic number, high structural strength, and high electrical conductivity.

The window 56 can be electrically conductive and can be electrically coupled to the anode 52. The enclosure 53 can be electrically conductive and can be electrically coupled to the window 56 (or the window 56 can form the entire enclosure 53). A power supply 54 can be electrically coupled to the cathode 51 and electrically coupled to the enclosure 53. The electrical coupling from the power supply 54 to the enclosure can be through a ground. Thus, electrons can flow from the power supply 54 to and through the cathode 51, from the cathode 51 to the anode 52 and from the anode 52 through the enclosure 53 back to the power supply 54.

The x-ray tube 11 can include a connector 57 for attaching the x-ray tube 11 to the lift-pin 19, or for attaching the x-ray tube 11 directly to the actuator 15, if the x-ray tube 11 is the entire lift-pin 19. The connector 27 can be threaded, a sleeve connector, a BNC connector, or other type of connector.

Methods of electrostatic dissipation of a bottom side of a flat-panel-display (FPD) during manufacture of the FPD 13 can include some or all of the following steps, which can be performed in the order shown, or other order. The devices described in the methods, including the table 12, the lift-pin(s) 19, the lift-cylinder(s) $\mathbf{19}_c$, and the x-ray tube(s) 11, can have characteristics as described above.

The method can include lifting the FPD 13 off of the table 12, then emitting x-rays 17 between the FPD 13 and the table 12.

In one embodiment, as shown in FIGS. 1*a-b*, the table can have multiple holes 18, including one or more first holes $\mathbf{18}_f$ and one or more second holes $\mathbf{18}_s$. The second hole(s) $\mathbf{18}_s$ are different from the first hole(s) $\mathbf{18}_f$. Lifting the FPD 13 can include using one or more lift-pins 19, each of which can be located in a first hole $\mathbf{18}_f$ (usually one lift-pin 19 per each first hole $\mathbf{18}_f$), to at least assist in lifting the FPD 13 off of the table 12. Emitting x-rays 17 can include emitting the x-rays 17 from one or more x-ray tubes 11, each located in a second hole $\mathbf{18}_s$ (usually one x-ray tube 11 per each second hole $\mathbf{18}_s$). The second hole(s) $\mathbf{18}_s$ can be free of any lift-pin(s) 19 configured for lifting the FPD 13. The x-ray tube(s) 11 can be mounted, fixed and stationary with respect to the table 12 during lifting of the FPD 13. In one aspect, an x-ray emission-end of the x-ray tube(s) 11 can be located from flush with, to a distance d of up to 10 millimeters below, a bearing-surface $\mathbf{12}_s$ of the table 12.

In another embodiment, as shown in FIGS. 2*a-b*, lifting the FPD 13 can include using x-ray tube(s) 11 to at least assist in lifting the FPD 13 off of the table 12. In one aspect, the x-ray tube(s) 11 can be configured to emit x-rays 17 radially outward and parallel to a bearing surface $\mathbf{12}_s$ of the table 12 and/or in a 360 degree arc around a circumference of the x-ray tube 11.

In another embodiment, as shown in FIGS. 3*a-b*, lifting the FPD 13 can include using at least one lift-cylinder $\mathbf{19}_c$ to at least assist in lifting the FPD 13 off of the table 12. The lift-cylinder(s) $\mathbf{19}_c$ can each be located in a hole 18 in the table 12 (usually one lift-cylinder $\mathbf{19}_c$ per hole 18). Emitting the x-rays 17 can include emitting x-rays 17 from one or more x-ray tubes 11, each located inside a hollow-core of one of the lift-cylinders $\mathbf{19}_c$. The x-ray tube(s) 11 can be fixed and stationary with respect to the table 12 during lifting of the FPD 13.

In another embodiment, as shown in FIGS. 4*a-b*, lifting the FPD 13 can include using one or more lift-pins 19, each located in a hole 18 in the table 12 (usually one lift-pin 19 per hole 18), to at least assist in lifting the FPD 13 off of the table 12. Emitting x-rays 17 can include emitting the x-rays 17 from one or more x-ray tubes 11 located around at least a portion of a periphery of the table 12. The x-ray tube(s) 11 can circumscribe the table 12. The x-ray tube(s) 11 can be oriented substantially parallel with a bearing-surface $\mathbf{12}_s$ of the table 12.

It can be important, to avoid wasted electrical power, to avoid overheating the x-ray tube 11, and to avoid early failure of the x-ray tube(s) 11, for the x-ray tube(s) 11 to activate and emit x-rays 17 only while the FPD 13 is being lifted off of the table 12 and also possibly for a short time duration before and/or after lifting the FPD 13 off of the table 12. For example, the controller 22 can be configured to actuate the x-ray tube(s) 11 no more than thirty seconds prior in one aspect, no more than one minute prior in another aspect, or no more than three minutes prior in another aspect, to the FPD manufacturing machine 10, 20, 30, or 40 lifting the FPD 13 off of the table 12. As another example, the controller 22 can be configured to terminate emission of the x-rays 17 no later than one minute in one aspect, no later than three minutes in another aspect, or no later than ten minutes in another aspect, after the FPD manufacturing machine lifted the FPD 13 off of the table 12.

The term "x-ray tube" is used herein, because this is a standard term in this industry, but the x-ray tube(s) 11 are not necessarily cylindrical or tubular in shape.

What is claimed is:

1. A flat-panel-display (FPD) manufacturing machine comprising a table, a lift-pin, an actuator, and an x-ray tube, wherein:

a. the table has a hole;
b. the lift-pin is movably located in the hole;
c. the actuator is configured to exert a force on the lift-pin to at least assist in causing the lift-pin to lift the FPD off of the table; and
d. the x-ray tube forms at least a vertical segment of and is movable along with the lift pin.

2. The FPD manufacturing machine of claim 1, further comprising a spacer, wherein the spacer is:

a. electrically-insulative;
b. located at an x-ray emission-end of the x-ray tube;
c. configured to electrically insulate the x-ray tube from the FPD; and
d. configured to maintain a predetermined distance between the emission-end of the x-ray tube and the FPD when lifting the FPD.

3. The FPD manufacturing machine of claim 1, wherein the x-ray tube is the entire lift-pin.

4. The FPD manufacturing machine of claim 2, wherein the predetermined distance is between 3-10 millimeters.

5. The FPD manufacturing machine of claim 2, wherein the spacer comprises a polymer.

6. The FPD manufacturing machine of claim 2, wherein the spacer comprises polyether ether ketone.

7. The FPD manufacturing machine of claim 2, wherein the spacer is hollow, forming a region for formation of ions.

8. The FPD manufacturing machine of claim 7, wherein the spacer is vented and the vents allow passage of ions and x-rays outward from the spacer.

9. The FPD manufacturing machine of claim 2, wherein the spacer is part of a shell, a hollow region of which shell extends beyond the emission-end of the x-ray tube to form the spacer.

10. The FPD manufacturing machine of claim 1, further comprising a controller configured to cause the x-ray tube to emit x-rays between the FPD and the table when the lift-pin at least assists in lifting the FPD off of the table.

11. The FPD manufacturing machine of claim 10, wherein the controller comprises a power supply for the x-ray tube.

12. A flat-panel-display (FPD) manufacturing machine comprising a table, a lift-ping an actuator, and an x-ray tube, wherein:

a. the table includes:
   i. an insulative outer layer configured to face and contact he FPD; and
   ii. a hole;
b. the is movably located in the hole;
c. the actuator is configured to exert a force on the lift-pin to at least assist in causing the lift-pin to lift the FPD off of the table;
d. the table is configured for mounting an x-ray tube for dissipation of static electricity on a bottom side of the FPD during manufacture of the FPD;
e. the lift-pin is a lift-cylinder with a hollow-core; and
f. the x-ray tube is located inside the hollow-core of the lift-cylinder and is mounted fixed and stationary with respect to the table.

13. The FPD manufacturing machine of claim 12, wherein the lift-cylinder comprises carbon fiber composite.

14. The FPD manufacturing machine of claim 12, wherein the lift-cylinder is vented to allow ions and x-rays to more easily pass outside of the hollow-core of the lift-cylinder.

15. A flat-panel-display (FPD) manufacturing machine comprising a table, a lift-pin, an actuator, and an x-ray tube, wherein:

a. the table includes:
   i. an insulative outer layer configured, to face and contact the FPD; and
   ii. a hole and a second-hole;
b. the lift-pin is movably located in the hole;
c. the actuator is configured to exert a force on the lift-pin to at least assist in causing the lift-pin to lift the FPD off of the table;
d. the table is configured for mounting an x-ray tube for dissipation of static electricity on a bottom side of the FPD during manufacture of the FPD;
e. the x-ray tube is mounted, fixed and stationary with respect to the table, inside the second-hole; and
f. no lift-pin, configured to at least assist in lifting the FPD, is located in the second-hole.

16. The FPD manufacturing machine of claim 15, wherein:

a. the table has a bearing-surface for holding the FPD; and
b. an x-ray emission-end the x-ray tube is located from flush with, to a distance of up to 10 millimeters below, the bearing-surface of the table.

17. A method of claim 10, electrostatic dissipation of a bottom side of a flat-panel-display (FPD) during manufacture of the FPD, the method comprising lifting the FPD off of a table; emitting x-rays between the FPD and the table when the FPD is, lifted off of the table; and wherein lifting the FPD includes using an x-ray tube to at least assist in lifting the FPD off of the table.

18. The method of claim 17, wherein:

a. the table has a bearing-surface for holding the FPD; and
b. the x-ray tube is configured to emit x-rays radially outward and parallel to the bearing surface.

19. The method of claim 18, wherein the x-ray tube is configured to emit x-rays radially outward and parallel to the bearing surface in a 360 degree arc around a circumference of the x-ray tube.

20. The method of claim 19, wherein an anode of the x-ray tube has a convex surface with target material and a window of the x-ray tube is annular-shaped.

* * * * *